United States Patent [19]

Ward

[11] 4,061,151

[45] Dec. 6, 1977

[54] GUTTER MANIPULATING APPARATUS AND METHOD

[76] Inventor: Edwin J. Ward, 13839 Clifton Blvd., Lakewood, Ohio 44107

[21] Appl. No.: 613,444

[22] Filed: Sept. 15, 1975

[51] Int. Cl.[2] ..... B08B 7/02; E04D 13/06

[52] U.S. Cl. ..... 134/33; 52/11; 52/12; 52/16; 248/48.1

[58] Field of Search ..... 134/33, 23; 52/11, 12, 52/15, 16, 74; 248/48.1

[56] References Cited

U.S. PATENT DOCUMENTS

| | | | |
|---|---|---|---|
| 510,515 | 12/1893 | McKenney | 52/16 |
| 2,523,435 | 9/1950 | Jones | 52/16 |
| 2,624,299 | 1/1953 | Beegle | 52/16 |
| 2,733,484 | 2/1956 | Jedlicka | 52/74 X |
| 2,963,290 | 12/1960 | Bauer | 52/74 X |
| 3,077,055 | 2/1963 | Tripp, Jr. | 52/12 |
| 3,355,895 | 12/1967 | Bayes et al. | 52/11 X |
| 3,357,143 | 12/1967 | Bayes et al. | 52/11 |

FOREIGN PATENT DOCUMENTS

| | | |
|---|---|---|
| 302,511 | 7/1968 | Sweden. |

*Primary Examiner*—Richard V. Fisher

*Attorney, Agent, or Firm*—Watts, Hoffmann, Fisher & Heinke Co.

[57] ABSTRACT

An apparatus and method is disclosed for manipulating a gutter to facilitate the dumping of debris from the gutter. Mounting structure supports the gutter for rotation about a longitudinal axis of the gutter, the longitudinal axis being located within the gutter between its upper edge and its bottom whereby the radius of rotary motion of the gutter is less than its depth. A drive apparatus is connected to rotate the gutter in response to the application of power thereto. A crank assembly is connected to the drive apparatus to transmit power to the drive apparatus for rotating the gutter. The drive apparatus responds to the application of power to the crank assembly in a continuous uniform fashion to rotate the gutter over a reciprocatory rotational excursion. Detent structure indicates when the gutter is in a substantially upright position. Structure is disclosed for providing for fluid communication between two gutters rotatable relative to one another, without inhibiting their relative rotatability. Alternate cranking and drive apparatus is also disclosed which is responsive to rotative motion of the cranking apparatus to rotate the gutter over an angular displacement substantially equal to that of the rotation of the cranking assembly.

20 Claims, 19 Drawing Figures

GUTTER MANIPULATING APPARATUS AND METHOD

BACKGROUND OF THE INVENTION

Field of the Invention

This invention relates to apparatus for manipulating a gutter to dump debris from the gutter.

SUMMARY OF THE INVENTION

The present invention encompasses improved apparatus and method for manipulating a gutter on a building to facilitate the dumping of debris from the gutter. The invention is encompassed by apparatus and method for mounting the gutter for rotative motion about a longitudinal axis of the gutter and for rotating the gutter in a reciprocatory fashion in response to the application of power in a continuous and uniform fashion. This aspect of the invention makes it easy to impart rapid reciprocating motion to the gutter. This has the advantage of enabling the causation of rapid motion of the gutter by either manual action or a simple power source.

According to a further feature of the invention, the longitudinal axis about which the gutter is mounted extends proximate the center of mass of the gutter. This enables rotation of the gutter by the application of a relatively low and uniform rate of power.

Another feature includes apparatus and method for impacting the gutter when it reaches a predetermined extreme location in its reciprocatory excursion. The impacting of the gutter at its limit of excursion assists in dislodging debris which adheres to the bottom of the gutter, such as wet leaves. According to another aspect of the invention, there is provided a method and apparatus for manipulating a gutter which furnishes an indication of when the gutter is in a substantially upright attitude. This indication enables a user to easily position the gutter in its operative upright attitude following its cleaning.

Another feature of the invention includes an apparatus and method for manipulating a gutter, the apparatus having structure for longitudinally mounting the gutter and rotation-imparting structure connected to the gutter. The rotation means includes a rotatable cranking element, and structure connecting the cranking element to the gutter. The connecting structure is responsive to rotation of the cranking element to rotate the gutter over an angular displacement which is substantially equal to the angular displacement of the rotation of the cranking element. This feature enables an operator to gauge the degree of rotation of the gutter by the corresponding rotation of the cranking element, to easily control the degree of rotation and the rotational position of the gutter.

The invention summarized above, and its attendant advantages, are more fully appreciated in connection with the following description of the preferred embodiment, taken in connection with the drawings, in which:

DESCRIPTION OF THE PREFERRED EMBODIMENT

Figure 1:
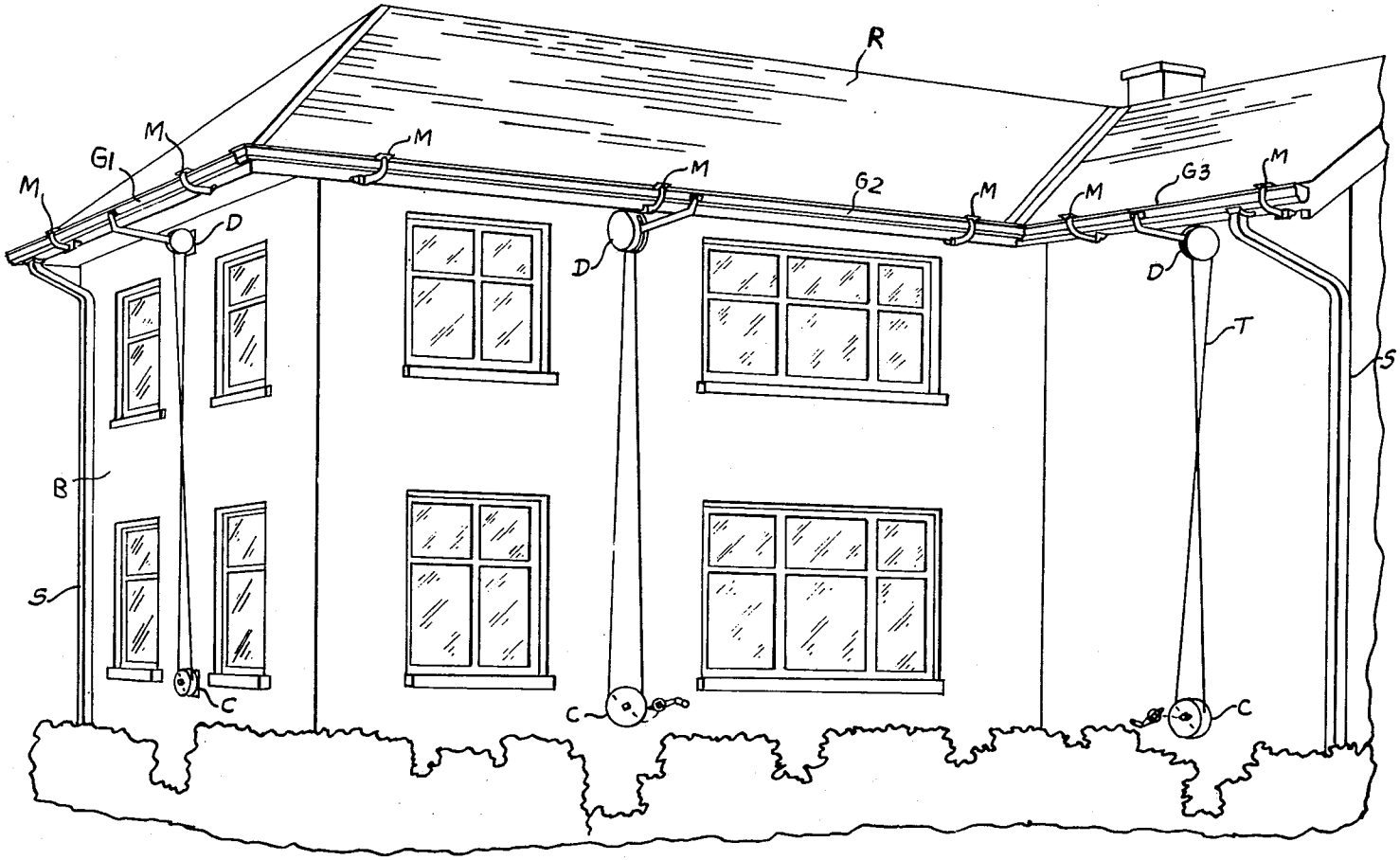
FIG. 1 is a pictorial view showing a gutter manipulating apparatus constructed in accordance with the present invention in an operative installation.

FIG. 1 shows a portion of a building B incorporating apparatus embodying the present invention. The building B has a roof portion R, with a series of gutters G1, G2, G3 positioned to catch eavesdrip from the roof R. Downspouts S communicate with the gutters to collect and drain away eavesdrip collected by the gutters.

A plurality of mounting structures M support the gutters G1, G2, G3 for rotational motion about longitudinal axes of the respective gutters. A drive assembly D is connected to each of the gutters. Each drive assembly D responds to power applied thereto to impart reciprocal rotational motion to its associated gutter. A different crank apparatus C is connected to each drive assembly D to apply power to the drive assembly for causing rotation of the associated gutter. Each crank assembly C is connected to its associated drive assembly D by an elongated power transmissive element T.

Figure 2:
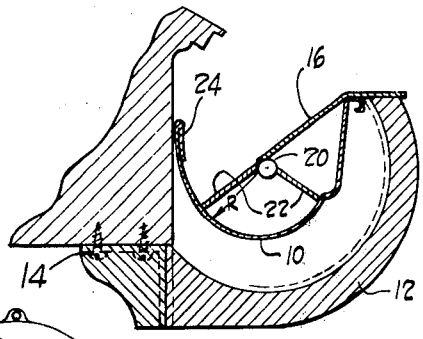
FIG. 2 is a detailed view, partially in cross section, of a portion of the apparatus shown in FIG. 1.
Figure 7:
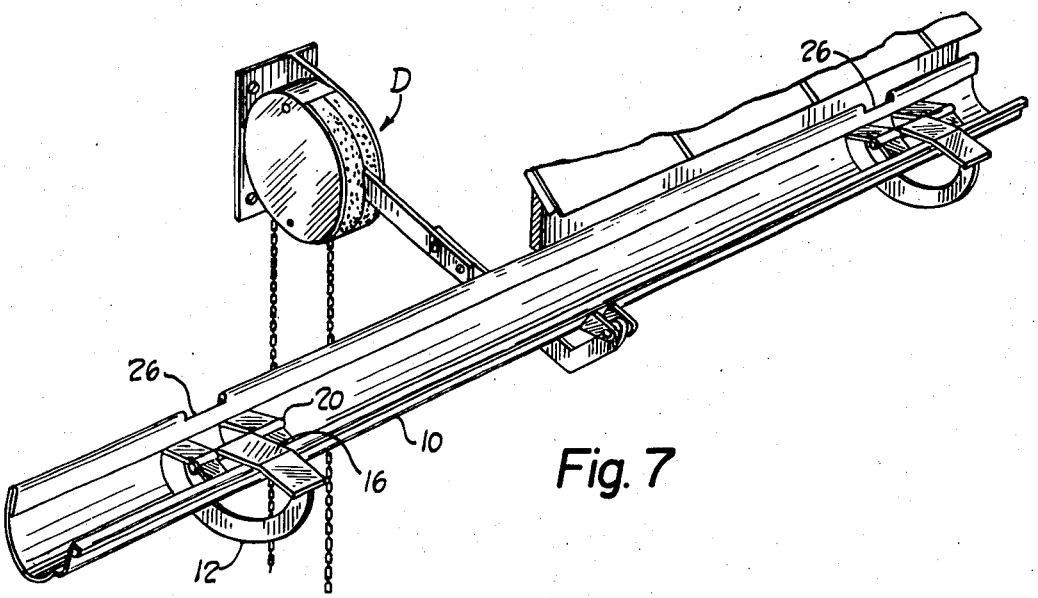
FIG. 7 is a pictorial view, partially in cross section, showing a portion of the structure illustrated in FIG. 1.

The structure of the gutters G1, G2, G3 is illustrated in several of the figures, particularly in FIGS. 2 and 7. Each gutter includes a generally channel-shaped portion 10. Each channel-shaped portion 10 is of a length commensurate with the length of the building wall near which the gutter is supported. The channel-shaped gutter member is appropriately made from a rolled and shaped portion of metal. The metal can be aluminum, or a ferrous metal painted or otherwise coated to inhibit corrosion.

Preferably, the gutters are supported in an inclined fashion so that eavesdrip from the roof R tends to drain toward the drainspouts S. An appropriate slope of inclination for the gutters G1, G2, G3 is approximately one inch of elevational change for each ten feet of gutter length.

An example of one of the mounting structures M is illustrated in FIGS. 2 and 7. The mounting structures M support the gutters for rotational motion about a longitudinal axis of the gutter. Each mounting structure M includes a generally C-shaped bracket 12 mounted on the underside of the eave of the building B by a plurality of screws 14. The gutter is rotationally supported on the bracket 12 by a hinge member 16, fixedly attached to the outer end of the bracket 12. The hinge member extends downwardly from the end of the bracket 12 to the interior of the arc generally described by the curvature of the bracket 12. A pivot member 20 is fixed to the end of the hinge member 16, near the longitudinal center of mass of the gutter. The pivot member 20 extends outwardly from the hinge member 16 in directions generally parallel to the associated gutter.

Two pairs of leg members 22 are journaled on the pivot member 20. The leg members 22 are each fastened to the interior of the gutter channel member 10, by welding or by a suitable adhesive.

The channel member 10 of the gutter thus mounted on the mounting structure M is free to rotate about a longitudinal axis of the gutter coincident with the pivot member 20. This rotatability is illustrated, for example, in FIGS. 3 and 3A. The former figure illustrates the gutter in a substantially upright attitude, while the latter figure illustrates the gutter in a substantially inverted attitude for dumping debris from the gutter. Because the longitudinal center of mass of the gutter will change as materials of different densities accumulate within the gutter, it is desirable that the longitudinal axis about which the gutter pivots be located within the gutter between its upper edge and its bottom. By this construction, the radius of rotary motion of the gutter is less than its depth, as illustrated by the radius R in FIG. 2. That is, although the location of the longitudinal center of mass of the gutter may change, locating the pivot axis within the gutter as shown in FIG. 2 will assist in insuring that the gutter always can be rotated by the application of a relatively low force.

Provision is made for impacting the gutter channel member 10 at a point in its rotative movement. This impacting facilitates the dislodgement of debris, such as wet leaves, which may be adherent to the bottom of the gutter.

This feature is embodied by the gutter being constructed with a thickened portion 24 near its inner edge which impacts the hinge members 16 upon rotation of the gutter channel member 10 in a clockwise direction, as shown in FIG. 2. Preferably, the channel member 10 also defines a notch 26 (FIG. 7) aligned to engage the adjacent hinge member 16 when the channel member 10 is so rotated. The bottom of the notch 26 impacts the hinge member 16 to jar loose adherent debris.

Figure 3:
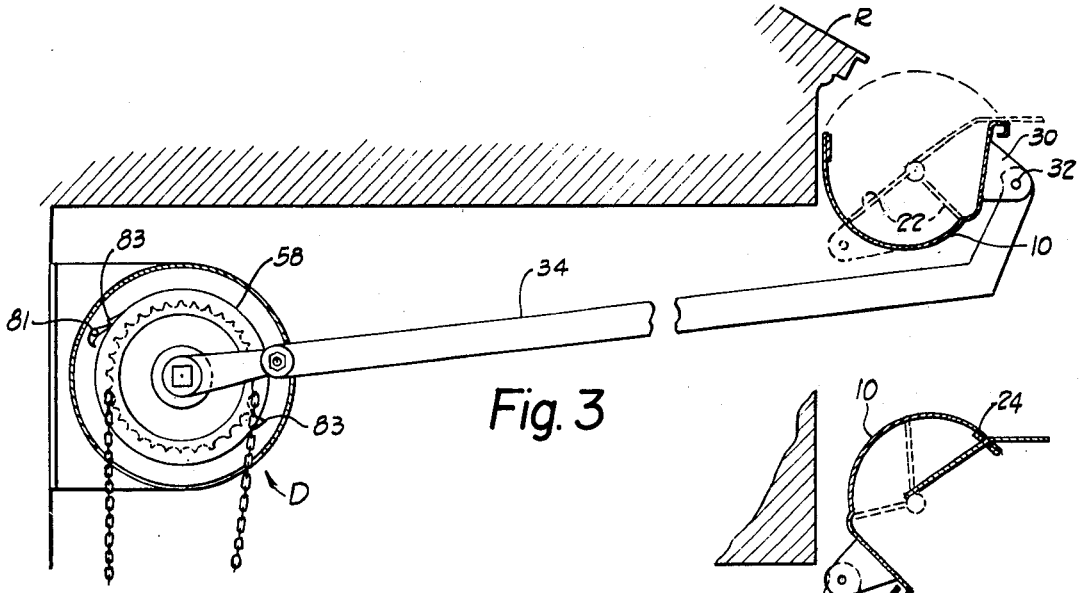
FIGS. 3 and 3A are detailed drawings, partially in cross section, of another portion of the apparatus shown in FIG. 1.
Figure 3A:
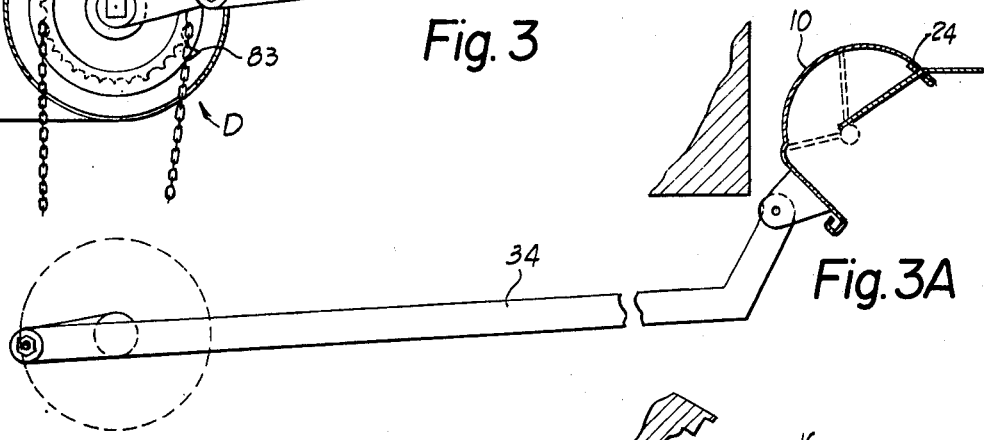

The connection of the gutter channel member 10 to its associated drive assembly D, and the operation of the drive assembly D to rotate the gutter, is shown in FIGS. 3 and 3A. FIG. 3 shows the gutter held in a substantially upright attitude, while FIG. 3A shows the gutter in a substantially inverted attitude for dumping debris from the channel member 10.

As shown in FIG. 3, the channel member 10 has an ear portion 30 affixed to its outside surface. The ear portion 30 is journaled by a pivot structure 32 to a reciprocable arm 34. The arm 34 is connected to the drive assembly D which reciprocates the arm 34 in response to power applied to the drive assembly D.

Figures 4, 5:
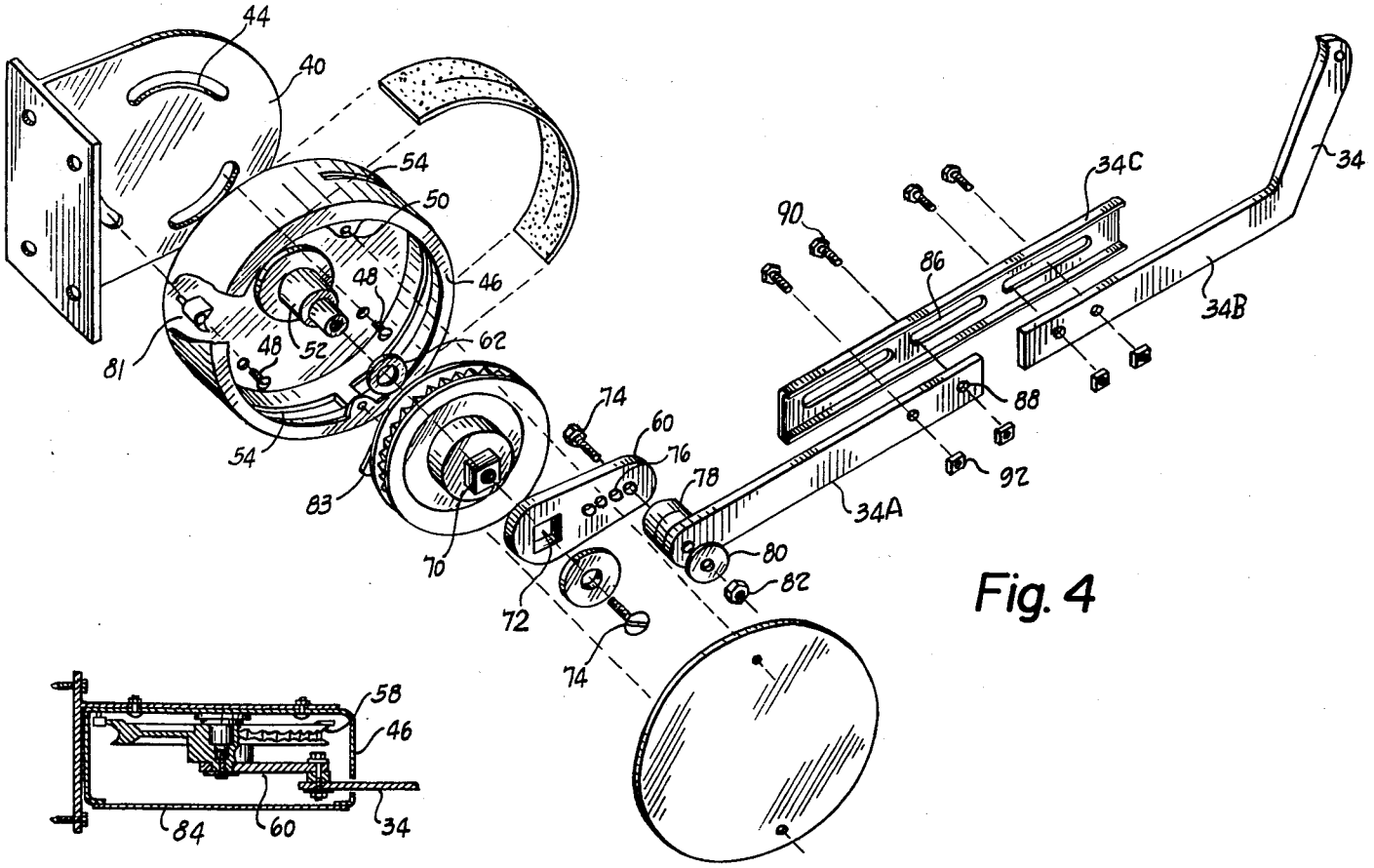
FIG. 4 is an exploded view showing a portion of the apparatus illustrated in FIG. 3.
FIG. 5 is a cross-sectional view of the portion of the apparatus shown in FIG. 4.

FIGS. 4 and 5 illustrate the drive assembly D in detail. FIG. 4 shows the drive assembly D in exploded format. Referring to FIG. 4, the drive assembly is mounted on the wall of the building B by a bracket plate 40. The bracket plate 40 is mountable on the building wall by screws (not shown) which may be inserted through a plurality of holes 42 defined in the bracket plate. The bracket plate 40 also defines a plurality of curved slots 44, for engagement with other parts of the drive assembly D, as explained below.

A crank case 46 is mounted on the bracket plate 40. The crank case 46 has a generally cylindrical shape, and is attached to the bracket plate 40 by bolts 48. The bolts 48 extend through a plurality of holes 50 in the crank case 46, the slots 44, and a corresponding plurality of nuts (not shown) which are used to fasten the bolts extending through the curved slots 44 in the bracket plate 40. The rotational attitude of the crank case 46 can be adjusted by loosening the screws 48 and rotating the crank case as permitted by the confines of the curved slots 44, and by then retightening the nuts and bolts. The crank case 46 also defines a pair of slots 54 extending circumferentially about the crank case 46. The function of the slots 54 will be described in detail later. The crank case 46 has mounted on it a central stepped shaft 52 extending axially with respect to the crank case 46.

The crank case 46 holds the operative members of the drive assembly D. These members include a pulley 58 which is attached to the reciprocable arm 34 by a rotatable lever 60. The pulley 58 is mounted on the stepped shaft 52 (with a washer 62 intervening). The pulley 58 has a set of teeth about its circumference, for engaging the power transmissive member T as described below.

The lever 60 is rotationally fixed with respect to the pulley 58 by means of a hex protrusion 70 on the pulley 58 which engages a corresponding aperture 72 defined by the lever 60. The lever 60 is axially fixed on the pulley 58 by means of an assembly including a washer 73 and a screw 74 engaged in a central hole defined by the pulley 58.

The arm 34 is attached to the lever 60 by means of a pivotal assembly including a bolt 74 which protrudes through a hole 76 defined in the lever 60, a bushing 78 and a washer 80. This pivotal assembly is fastened together by a nut 82 engaged on the end of the bolt 74.

In its assembled condition, the arm 34 extends through one of the circumferential slots 54 defined in the crank case 46. This is shown in FIG. 5. When the pulley 58 is caused to rotate, the lever 60 rotates with the pulley 58 and causes the arm 34 to move in and out of the slot 54 in the crank case 46. The arm 34 is thus caused to execute generally reciprocal motion by rotation of the pulley 58.

The drive assembly D has a detent structure. The detent enables positioning of the gutter in its upright position without requiring an operator to view the gutter.

The detent includes a clevis pin 81 pivotally mounted on the bracket plate 40. The pulley 58 has a pair of stop protrusions 83 at diametrically opposed positions on its periphery. When the pulley 58 is rotated counter-clockwise in FIG. 3, the pin 81 engages the first protrusion it encounters and stops its rotation. The protrusions are positioned on the pulley 58 so that, when the pin 81 engages them, the gutter is upright.

A cover plate 84 is fastened over the outer end of the crank case 46 in known fashion, such as by the use of screws (not shown).

Preferably, the arm 34 is adjustable in length. The adjustability of length enables use of the apparatus in applications involving various distances between the gutter and the drive assembly D. The adjustability of length is obtained by constructing the arm 34 in three portions, i.e., 34A, 34B, 34C. The portion designated 34C is a generally channel-shaped member used to join the portions 34A, 34B. The portion 34C is equipped with a plurality of slots 86, which can be aligned with holes 88 in the portions 34A, 34B. The portions 34A, 34B, 34C can be joined by adjustably positioning these three members in a desirable configuration, and fastening them together by the use of bolts 90 and nuts 92.

Figure 6A:
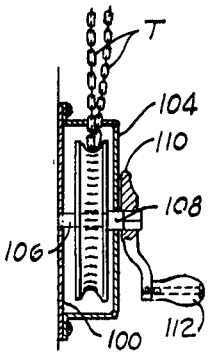
FIGS. 6, 6A and 6B are partial cross-sectional views showing another portion of the apparatus illustrated in FIG. 1.
Figure 6:
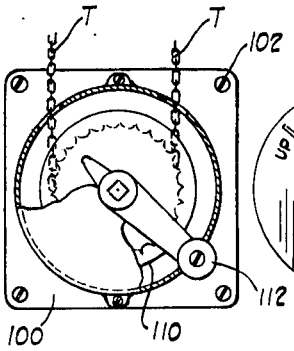
Figure 6B:
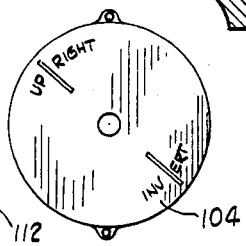

The construction of each of the crank assemblies C is illustrated in FIGS. 6, 6A and 6B. Each crank assembly C includes a bracket plate 100 which can be fastened to the side of the building B by a plurality of screws 102. A housing portion 104 is attached to the plate 100. A shaft 106 is journaled in a bearing 108 in the outer portion of the housing 104. A wheel 110 is rotatably fixed to the shaft 106. A bell crank 112 is attached to rotate the shaft 106 and the wheel 110.

The elongated transmissive member T is reeved around the wheel 110 and extends upwardly to the drive assembly D. The transmissive member T is preferably a suitably designed chain or belt. The transmissive member T extends through the lower one of the circumferential slots 54 in the crank case 46 (FIG. 4) and is reeved around the pulley 58.

When the crank 112 is rotated, rotating the wheel 110 and driving the transmissive member T, the pulley 58 is correspondingly caused to rotate. Rotation of the pulley 58 and the lever 60, attached to the pulley 58, causes the arm 34 to execute reciprocatory motion, moving the gutter back and forth over a reciprocal rotational excursion.

Figures 8, 8A, 9, 9A, 9B:
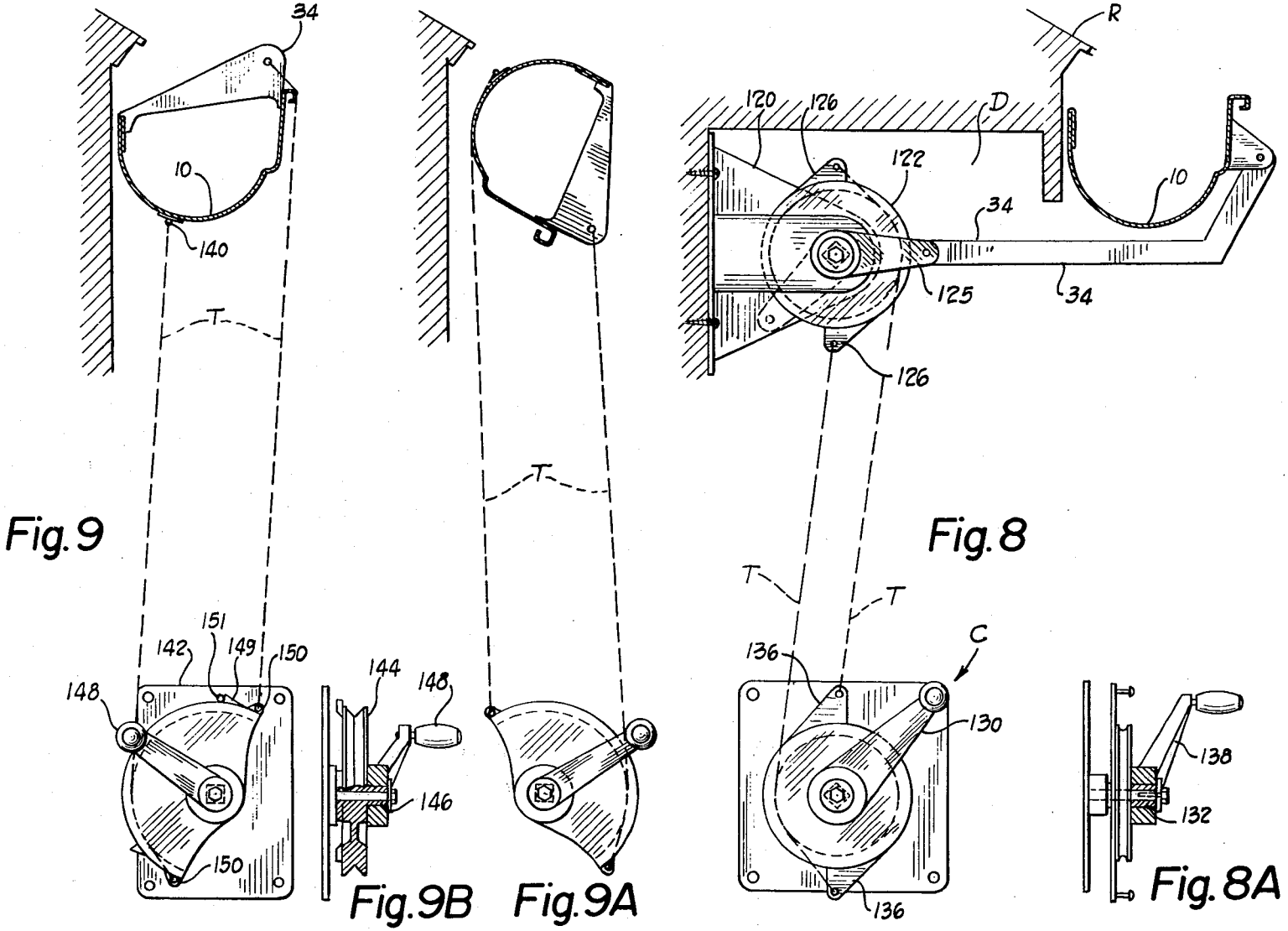
FIGS. 8 and 8A are partial cross-sectional views illustrating another embodiment of the apparatus shown in FIG. 1.
FIGS. 9, 9A and 9B are diagrammatical views illustrating the embodiment shown in FIGS. 8 and 8A.

Alternate embodiments for the drive assembly D and the crank assembly C are illustrated in FIGS. 8–9B.

In this alternate embodiment, the drive assembly D includes a bracket 120 attached to the wall of the building B. A wheel 122 is journaled on a pivot member 124 extending through the bracket 120. A lever 125, similar to the lever 60 is rotationally fixed to the wheel 122. The wheel 122 bears a pair of projections 126 extending outwardly from the wheel at diammetrically opposite locations.

The transmissive element T in this embodiment consists of a pair of ropes, wires or cables extending between the drive assembly D and the cranking assembly C. One end of one of the transmissive members is attached to each of the protrusions 126 on the wheel 122. When force is exerted on the transmissive members T, the wheel 122 is caused to rotate and the corresponding rotation of the lever 125 imparts rotative motion to the gutter channel member 10.

In this embodiment, the crank assembly C includes a bracket plate 130 attached to the wall of the building B. Extending outwardly from the bracket plate 130 is a shaft 132. A wheel 134, having a pair of diammetrically opposed projections 136, is journaled on the shaft 132. A bell crank 138 is connected to the wheel 134 to effect its rotation when the crank 138 is turned.

The ends of the transmissive members 10 opposite those ends connected to the protrusions 126 on the wheel 122 are connected to the protrusions 136 on the wheel 134. When the crank 138 is turned, so is the wheel 122, and the gutter channel 10 rotates in response.

Preferably, the size of the wheels 134 and 122, and of their corresponding projections 126 and 136, are substantially identical.

Still another embodiment of the gutter manipulating apparatus of this invention is shown in FIGS. 9, 9A and 9B. In this embodiment, no drive assembly D is necessary, only a cranking assembly C being required.

According to this embodiment, the transmissive elements T include a pair of rope, wire, or cable portions. One end of each of the portions of the transmissive members T is connected to the ear portion 34 on the gutter channel 10 and a second protrusion 140 which is fastened to the bottom portion of the gutter channel member 10. Tension applied to one or the other of these transmissive elements T causes the gutter to rotate accordingly.

The cranking assembly C is similar to that described in connection with the previous embodiment. A bracket plate 142 is attached to the wall of the building B. A wheel 144 is journaled on a shaft 146 attached to the bracket plate 142. A bell crank 148 is used to impart rotation to the wheel 144. The wheel 144 is provided with a pair of diammetrically opposed protrusions 150, each of which is attached to one end of a different one of the transmissive members T.

The protrusion 140 is located at a point approximately diammetrically opposite the ear portion 34 with respect to the longitudinal axis about which the gutter channel member 10 is mounted. The distance of each of the ear portion 34, (at the point of joining to the transmissive member T) and the protrusion 140, from the axis is approximately equal to the distance of the protrusions 150 from the center of the wheel 144.

In operation, when the ball crank 148 is rotated, and correspondingly the wheel 144 is also rotated, the gutter channel member 10 is also rotated over an angular displacement which is substantially equal to the angular displacement of the bell crank 148. An operator can thus judge the rotational position of the gutter directly by simply observing the position of the bell crank 148. There is no need to peer upwardly to observe the distant gutter in order to rotate the gutter for dumping debris, or to align the gutter in its substantially upright position after the cleaning is completed.

Detent structure is preferably provided on the crank assembly C, to provide an indication of when the gutter is upright. The detent structure includes a stepped, ratchet-like protrusion 149 on the periphery of the wheel 144 engageable with a pin 151 attached to the plate bracket 142. The protrusion 149 is positioned to engage the pin 151 when the gutter is upright, indicating that it is properly positioned by emitting an audible click and preventing movement in a counter-clockwise direction (FIG. 9).

Figure 10:
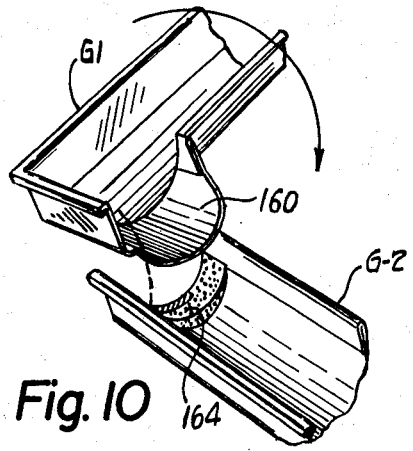
FIG. 10 is a pictorial view showing a portion of the apparatus illustrated in FIG. 1.

FIG. 10 shows an embodiment of structure for connecting adjacent gutters for fluid flow therebetween. Notwithstanding the fluid connection between the gutters, it is still possible in this embodiment to rotate each of the gutters with respect to the other for enabling cleaning. FIG. 10 shows the juncture between the gutters G1, G2.

In this embodiment, a channel-shaped structure 160 is attached at right angles to the bottom portion of a gutter G1 near its end. The inner edge of the channel member 10 of the gutter G1 is cut out in the region of the channel structure 160, to enable fluid flow from the gutter G1 outwardly over the channel member 160.

The gutter G2 has an open end adjacent the region of the channel structure 160. The open end of the gutter G2 is suitable for accommodating the channel structure 160 to form a path whereby fluid can flow from the gutter G1, over the channel structure 160 and into the gutter G2, when the channel structure 160 is rotated down into the gutter G2 near its bottom.

A portion 164 of resilient material, such as foam rubber or the like, is preferably adhered to the bottom of the gutter G2 in the region of its engagement with the channel structure 160. When the gutter G1 is rotated in the direction of the arrow of FIG. 10 such that the channel structure 160 engages the resilient portion of material 164, this engagement forms a substantially fluid-tight joint between the gutters G1 and G2 to prevent dripping from the gutters at the region of their intersection.

The structure shown in FIG. 10, while providing a fluid-tight intersection between gutters, also permits the gutters to be independently rotated. In operation, the gutter G1 is rotated, in any of the fashions described above, in a direction opposite that of the arrow in FIG. 10. This rotation causes the channel structure 160 to move upwardly and outwardly with respect to the gutter G2. Rotation of the gutter G1 can then be continued until cleaning is complete.

To clean the gutter G2, an operator first rotates the gutter G1 in a direction opposite that of the arrow in FIG. 10. This disengages the channel structure 160 from the gutter G2, permitting rotation of the gutter G2. The gutter G2 may then be rotated in any of the fashions described above for cleaning.

Figure 11:
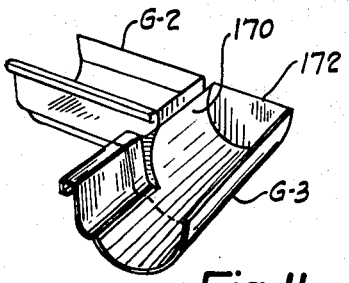
FIG. 11 is a pictorial view illustrating another embodiment of the structure shown in FIG. 10; and, FIGS. 12 and 12A are exploded and cross-sectional views, respectively, showing another portion of the apparatus illustrated in FIG. 1.

FIG. 11 shows gutter structure for providing an intersection between two gutters not having fluid communication therebetween. This situation obtains, for example, in the case of the gutter G2, G3. This embodiment provides for a minimum of clearance between the gutters G2, G3 to minimize eavesdrip falling between them.

In this embodiment, the gutter G3 is provided with an inset portion 170. The inset portion 170 is adjacent the end 172 of the gutter G3 near the adjacent end of the gutter G2. The inset 170 is sized to generally conform to the width of the gutter G2, to allow general engagement of the gutter G2 in the inset 170.

This structure enables both the gutters G2 and G3 to be independently rotated, for cleaning, while preserving the general continuity of the gutter system.

Figure 12A:
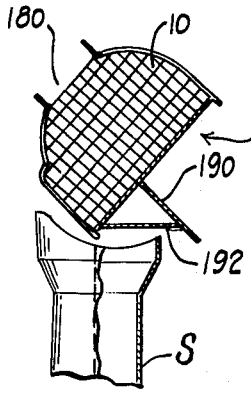
Figure 12:
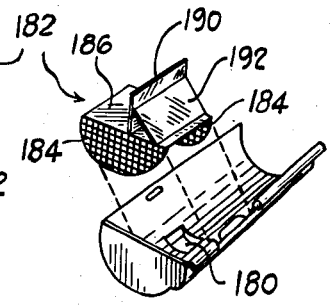

FIGS. 12 and 12A illustrate a particular structure for facilitating fluid flow between the portion 10 of a gutter and a downspout S. The structure shown in FIGS. 12 and 12A aids in preventing debris from the gutter from plugging the drainspout S.

The gutter portion 10 defines in its bottom an opening 180. The opening 180 is located such that it is positioned above the upper end of the drainspout S when the gutter portion 10 is in its substantially upright position. The apparatus of FIGS. 12 and 12A also includes a screen assembly 182. The screen assembly covers the opening 180 and prevents debris from being washed over and into the opening 180.

The screen assembly 182 includes a pair of generally semicircular screen elements 184 joined by a connecting member 186. The screen elements 184 are preferably shaped to correspond to the cross-sectional configuration of the portion 10 of the gutter. When the screen elements, connected by the member 186, are positioned in the gutter, the screen elements straddle the opening 180. The screen elements prevent debris in the gutter from washing over the opening 180 or down the downspout S.

The screen assembly 182 also includes a deflector 190. The deflector 190 is affixed to the connecting member 186 and is supported for added rigidity by a support member 192. The deflector 190 prevents debris accumulated on the top of the plate member 186 from falling into the downspout S when the gutter portion 10 is rotated for cleaning. As shown in FIG. 12A, the deflector 190 extends outwardly from the gutter portion 10 for a sufficient distance to prevent debris which has accumulated on top of the member 186 from falling into the downspout S when the gutter is rotated.

It is to be understood that the embodiment described in this application is intended as illustrative, and not as exhaustive of the invention. It is to be recognized that those of ordinary skill can make changes, modifications and adaptations of the embodiment described herein without departing from the scope of the invention as described and claimed in the following claims.

What is claimed is:

1. A gutter manipulating apparatus for dumping debris from a gutter, comprising:

a. structure supporting the gutter for rotation about a longitudinal axis of the gutter, b. means for imparting reciprocatory rotary motion to the gutter about the longitudinal axis in response to the continuous and uniform application of power to the reciprocation imparting means, and c. said longitudinal axis being located within the gutter between its upper edge and its bottom whereby the radius of rotary motion of the gutter is less than its depth.

2. The apparatus of claim 1, wherein the longitudinal axis extends proximate the longitudinal center of mass of the gutter.

3. The apparatus of claim 1, further comprising:

a member position to be impacted by the gutter when the gutter reaches a predetermined location in an excursion of its reciprocatory motion to assist in dislodging debris from the gutter.

4. The apparatus of claim 3, wherein;

the impact member is fixed relative to the supporting structure.

5. The apparatus of claim 3, wherein the impact member is positioned to be impacted by the gutter at a predetermined location of the gutter's excursion at which the gutter is generally inverted.

6. The apparatus of claim 1, wherein the reciprocation-imparting means comprises:

a. an arm coupled to the gutter;

b. a drive assembly responsive to the applied power for moving the arm in a substantially reciprocating fashion, and c. a crank assembly for applying power to the drive assembly.

7. The apparatus of claim 6, wherein;

a. the drive assembly comprises a pulley and a lever connected to the arm and being responsive to rotation of the pulley to reciprocate the arm, and b. the crank assembly comprises a crank, a wheel connected to the crank and an elongated drive element connected between the wheel and the pulley for rotating the pulley in response to rotation of the crank.

8. The apparatus of claim 7, further comprising:

a. the pulley defining a notched portion, and b. a pin mounted to engage the notched portion in response to the rotation of the pulley in one direction at a point of its rotation at which the gutter is substantially upright.

9. The apparatus of claim 7, further comprising:

a detent structure associated with the crank assembly for providing an index indicating when the gutter is in a substantially upright position.

10. The apparatus of claim 1, further comprising:

detent structure associated with the reciprocation-imparting means for providing an index indicating when the gutter is in a substantially upright position.

11. The gutter manipulating structure of claim 1, wherein the gutter has an opening in the bottom thereof to permit fluid flow from the gutter, further comprising a screen assembly including:

a. a pair of screen elements having a shape generally conforming to the cross-sectional configuration of the gutter;

b. a connecting member connecting the pair of screen elements for holding the screen elements within and generally perpendicular to the longitudinal axis of the gutter, and separating the screen elements a sufficient distance to enable the screen elements to straddle the opening in the bottom of the gutter, to prevent passages of debris from the gutter through the opening.

12. The improvement of claim 11, wherein the opening in the bottom of the gutter is positioned in fluid communication with a drainspout when the gutter is in a substantially upright position, the improvement further comprising:

an upstanding deflector extending upwardly from the connecting element between the screen elements a sufficient distance to prevent debris accumulated atop the connecting element from falling into the drainspout when the gutter is rotated to a substantially inverted position.

13. Apparatus for connecting first and second adjacent gutters for fluid flow therebetween, the first gutter being mounted for rotative movement relative to the second gutter about a longitudinal axis, the apparatus comprising:

a channel structure connected to the first gutter and extending from the bottom portion of the first gutter into the bottom portion of the second gutter, when the first and second gutters are substantially upright, the channel structure being upwardly movable out of the second gutter upon rotation of the first gutter.

14. The apparatus of claim 13, further comprising:

a resilient member on the second gutter engageable with the channel structure when the first and second gutters are substantially upright to form a substantially water-tight seal between the channel structure and the bottom of the second gutter.

15. A method for manipulating a gutter to facilitate dumping of debris from the gutter, comprising the steps of:

a. supporting the gutter for rotation about a longitudinal axis of the gutter, said longitudinal axis being located within the gutter between its upper edge and its bottom whereby the radius of rotary motion of the gutter is less than its depth, and b. imparting reciprocatory rotary motion to the gutter about the longitudinal axis in response to the application of power thereto in a continuous and uniform fashion.

16. The method of claim 15, wherein the supporting step comprises supporting the gutter about a longitudinal axis proximate the center of mass of the gutter.

17. The method of claim 15, further comprising the step of:

impacting the gutter upon a member fixed with respect to the support structure when the gutter reaches a predetermined location in an excursion of its reciprocatory motion to assist in dislodging debris from the gutter.

18. The method of claim 17, wherein the impacting step comprises impacting the gutter when it is in a generally inverted disposition.

19. The method of claim 15, further comprising the step of:

providing an indication when the gutter reaches a predetermined point of its rotational motion.

20. Apparatus for manipulating a gutter to assist in dumping debris therefrom, comprising:

a. structure for mounting the gutter for rotative motion about a longitudinal axis of the gutter; and b. rotation imparting structure connected to the gutter including:

i. a rotatable cranking element, and ii. structure connecting the cranking element to the gutter and being responsive to rotation of the crank to rotate the gutter over an angular displacement substantially equal to that of the rotative motion of the cranking element.

* * * * *